US005156385A

United States Patent [19]

Muto et al.

[11] Patent Number: 5,156,385

[45] Date of Patent: Oct. 20, 1992

[54] PRINTER HAVING AUTOMATIC PAPER FEED MECHANISM AND MANUAL PAPER FEED MECHANISM

[75] Inventors: Kiyoshi Muto, Yokkaichi; Hiroshi Koie, Nagoya, both of Japan

[73] Assignee: Brother Kogyo Kabushiki Kaisha, Nagoya, Japan

[21] Appl. No.: 791,192

[22] Filed: Nov. 13, 1991

[30] Foreign Application Priority Data

Nov. 28, 1990 [JP] Japan ..... 2-333327

[51] Int. Cl.[5] ..... B65H 5/00

[52] U.S. Cl. ..... 271/3; 271/9; 271/110; 271/265

[58] Field of Search ..... 271/3, 9, 110, 111, 271/258, 259, 265; 355/308, 309, 311

[56] References Cited

U.S. PATENT DOCUMENTS 3,626,956 12/1971 Sauder ..... 271/259
4,392,740 7/1983 Ito et al. ..... 355/309
4,470,689 9/1984 Nomura et al. .
4,483,528 11/1984 Takeyama et al. ..... 271/9
4,708,455 11/1987 Kubota et al. .
4,778,296 10/1988 Takahashi .
5,056,775 10/1991 Kida ..... 271/265
5,072,923 12/1991 Coy ..... 271/110

FOREIGN PATENT DOCUMENTS 0288089 10/1988 European Pat. Off. .
2068907 8/1981 United Kingdom ..... 271/9
2086860A 5/1982 United Kingdom .
2203413A 10/1988 United Kingdom .

*Primary Examiner*—H. Grant Skaggs
*Attorney, Agent, or Firm*—Oliff & Berridge

[57] ABSTRACT

In a printer having a manual sheet feed mechanism and an automatic sheet feed mechanism, when feed rollers of the manual paper feed mechanism are driven, a counter starts to count. At the time when the printing operation is completed, a CPU retrieves a predetermined value corresponding to a sheet length from a table stored in a ROM. The predetermined value represents the time necessary for the printing operation to be completed, with a tolerance. The CPU does not feed the next print sheet until the counter counts up to the predetermined value.

27 Claims, 5 Drawing Sheets

Fig.4

21a

| PAPER LENGTH (mm) | PREDETERMINED VALUE |
|---|---|
| 178 (B5 HORIZONTAL) | 11.0 |
| 210 (A4 HORIZONTAL) | 12.0 |
| 254 (B5 VERTICAL, B5 HORIZONTAL) | 13.0 |
| 305 (A4 VERTICAL, A3 HORIZONTAL) | 14.0 |
| 356 (B4 VERTICAL) | 15.0 |
| 420 (B4 VERTICAL) | 16.0 |

PRINTER HAVING AUTOMATIC PAPER FEED MECHANISM AND MANUAL PAPER FEED MECHANISM

BACKGROUND OF THE INVENTION

1. Field of the Invention

The present invention relates to a printer equipped with both automatic and manual sheet feed mechanisms, and more particularly to a printer which does not feed the next sheet until a predetermined time passes after sheet is inserted by a manual paper feed mode.

2. Description of Related Art

In a conventional printer capable of feeding sheets in both automatic and manual modes, a changeover switch mounted on a console panel or a changeover lever disposed in a sheet feed mechanism operate both automatic and manual sheet feed means so that the automatic or manual mode may be selected.

However, in the above described printer, the operation of the changeover switch or changeover lever leads to the selection of the automatic or manual mode, with concomitant problems inclusive of a cumbersome operation and print errors induced by faulty selection.

In order to solve the above problems, there is a printer provided with detector means for detecting whether or not a sheet is manually inserted in manual sheet feed means. Upon detection of the sheet by the detector means, the manual sheet feed means is automatically driven so that the sheet is fed to print means, for printing on the sheet.

However, in this type of printer, when a plurality of sheets are continuously inserted in the manual sheet feed means in case of the continuous print operation in the manual mode, it is possible that the plurality of sheets are fed in a superimposed state or that sheets in the automatic mode is mixed between the plurality of sheets continuously fed one after another in the manual mode.

SUMMARY OF THE INVENTION

The present invention is made to solve the above problems, and an object of the present invention is to provide a printer capable of feeding a plurality of sheets without mixing sheets fed in an automatic mode between the plurality of sheets continuously fed in a manual mode when the continuous print operation in the manual mode is performed.

Another object of the present invention is to provide a printer capable of feeding a plurality of sheets without sheets of papers being in a superposed state when the continuous print operation in the manual mode is performed.

To achieve the above and other objects, the printer according to the present invention comprises: a print means for printing characters and the like on the basis of print data output from an external unit on paper; a manual sheet insert portion for inserting sheets to be fed in a manual mode; a manual paper feed means for manually feeding sheets inserted from the manual sheet insert portion by an operator to the print means; a sheet cassette in which a plurality of sheets are stacked; an automatic sheet feed means for automatically feeding sheets stacked in the cassette one after another to the print means; a sheet detector means for detecting whether or not a sheet is inserted in the manual sheet feed means; a counter means for starting a count operation at the time when the manual sheet feed means is driven; and a sheet feed control means for controlling the manual sheet feed means to operate when the sheet detector means detects the presence of the sheets and until completion of the count operation of a predetermined value by the counter means In the printer according to the present invention thus constructed, the counter means starts a count operation when the manual sheet feed means is operated. The sheet feed control means drives the manual sheet feed means to feed the sheet to the print means when the sheet detector means detects the presence of the sheet and until completion of the count operation of a predetermined value by the counter means.

According to the present invention, as apparent from the above description, the sheet feed control means drives the manual sheet feed means to feed the paper to the print means when the sheet detector means detects the presence of the sheet during completion of the count operation of a predetermined value by the counter means. While, the automatic sheet feed means is not driven until the count operation of a predetermined value by the counter means is completed, thereby it is possible to prevent the sheet fed in an automatic mode from mixing between a plurality of sheets continuously fed in the manual mode. To prevent a plurality of sheets from feeding in a superimposed state when the continuous print operation in the manual mode is performed, a sheet discharge sensor controls operation of the manual sheet feed means to allow feeding of a sheet only after completion of printing of a previous sheet.

BRIEF DESCRIPTION OF THE DRAWINGS

A preferred embodiment according to the present invention will be described in detail with reference to the following figures wherein:

FIG. 4 is a table showing a predetermined value corresponding to the size of printing paper.

DETAILED DESCRIPTION OF THE PREFERRED EMBODIMENTS

One preferred embodiment according to the present invention will be explained hereunder with reference to the drawings.

Figure 1:
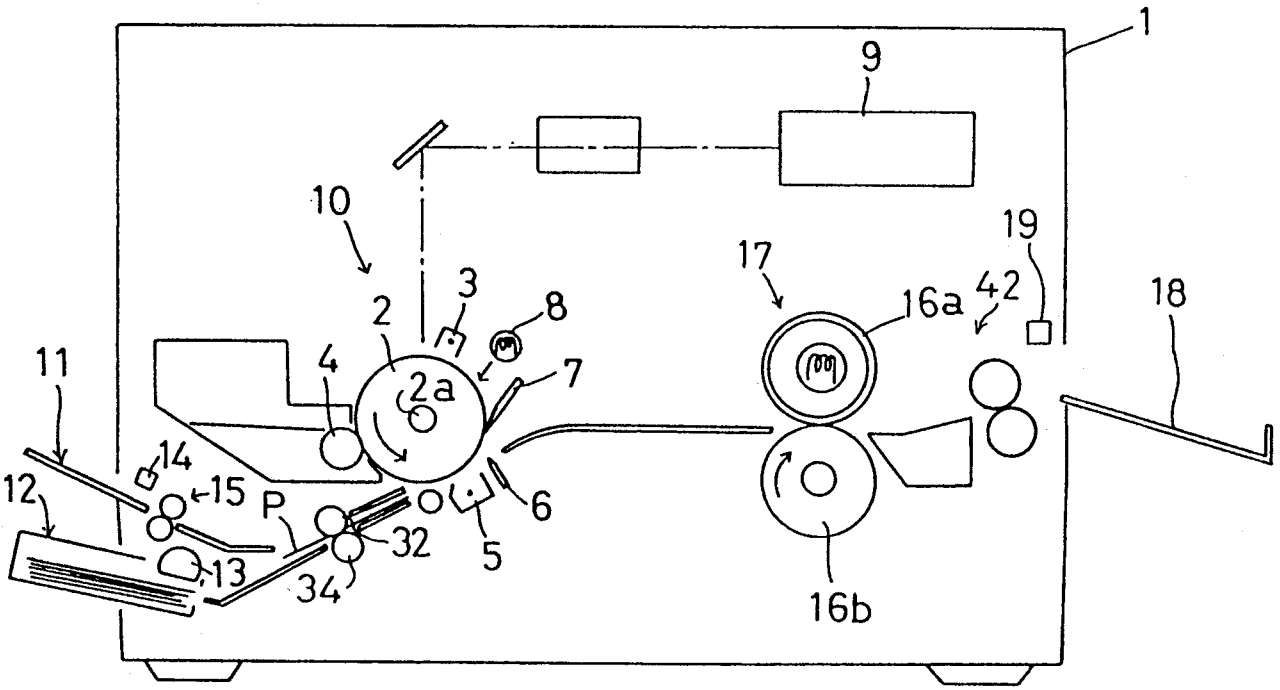
FIG. 1 is a schematic illustration of a laser printer which embodies the printing device of the present invention.

FIG. 1 shows one preferred embodiment where the present invention is applied to a laser printer. At the left of the laser printer 1 are disposed a manual sheet feeder 11 and an automatic sheet feeder 12 both described later, while at the right of the printer 1 is attached a sheet discharge tray 18. Inside the printer 1 between the automatic sheet feeder 12 and the sheet discharge tray 18, a photosensitive drum 2 and a heat fixing unit 17 are contained in order. Inside the printer 1 above the heat fixing unit 17 is disposed an optical scanning unit 9.

The photosensitive drum 2 is rotatably supported by a shaft 2*a*. Around the photosensitive drum 2, a charger 3, developing device 4, transfer charger 5, separation discharging brush 6, cleaner 7, pre-exposure lamp 8 are arranged in order counterclockwise in FIG. 1. Upon the rotation of the photosensitive drum 2 counterclockwise in FIG. 1, the surface thereof is charged by the charger 3. The charged surface of the photosensitive drum 2 is successively exposed to a laser beam scanned by the optical scanning unit 9. An exposed image formed by the laser beam is changed into a visible image by the developing device 4, and at the same time, the image is transferred on print paper P fed by the manual sheet feeder 11 or the automatic sheet feeder 12 by the transfer charger 5. The print paper P with the image transferred thereon is separated from the surface of the photosensitive drum 2 by the separation discharging brush 6, to be transported to the heat fixing unit 17.

The heat fixing unit 17 comprises a heat roller 16*a* heated by a heat source (not shown) and a roller 16*b* in pressure-contact with the heat roller 16*a*. The print paper P transported to the heat fixing unit 17 is held between the rollers 16*a* and 16*b*, and is discharged to paper discharge tray 18 disposed outside the printer 1 by a discharge roller 42 after fixing of the image by the heat of the heat roller 16*a*. A discharge sensor 19 is arranged between the discharge rollers 42 and the discharge tray 18. The discharge sensor 19 turns ON when it detects the leading edge of the print paper P, and turns OFF when a series of printing operations is completed. The rotation of the photosensitive drum 2 after the transfer of the image is continued. Residual toner is removed by the cleaner 7, and a uniform exposure can be performed by the pre-exposure lamp 8, thus preparing a subsequent print operation.

A print unit 10 includes the photosensitive drum 2, the charger 3, the developing device 4, the transfer charger 5, the separation discharging brush 6, the cleaner 7, the pre-exposure lamp 8, and the optical scanning system 9.

Figure 2:
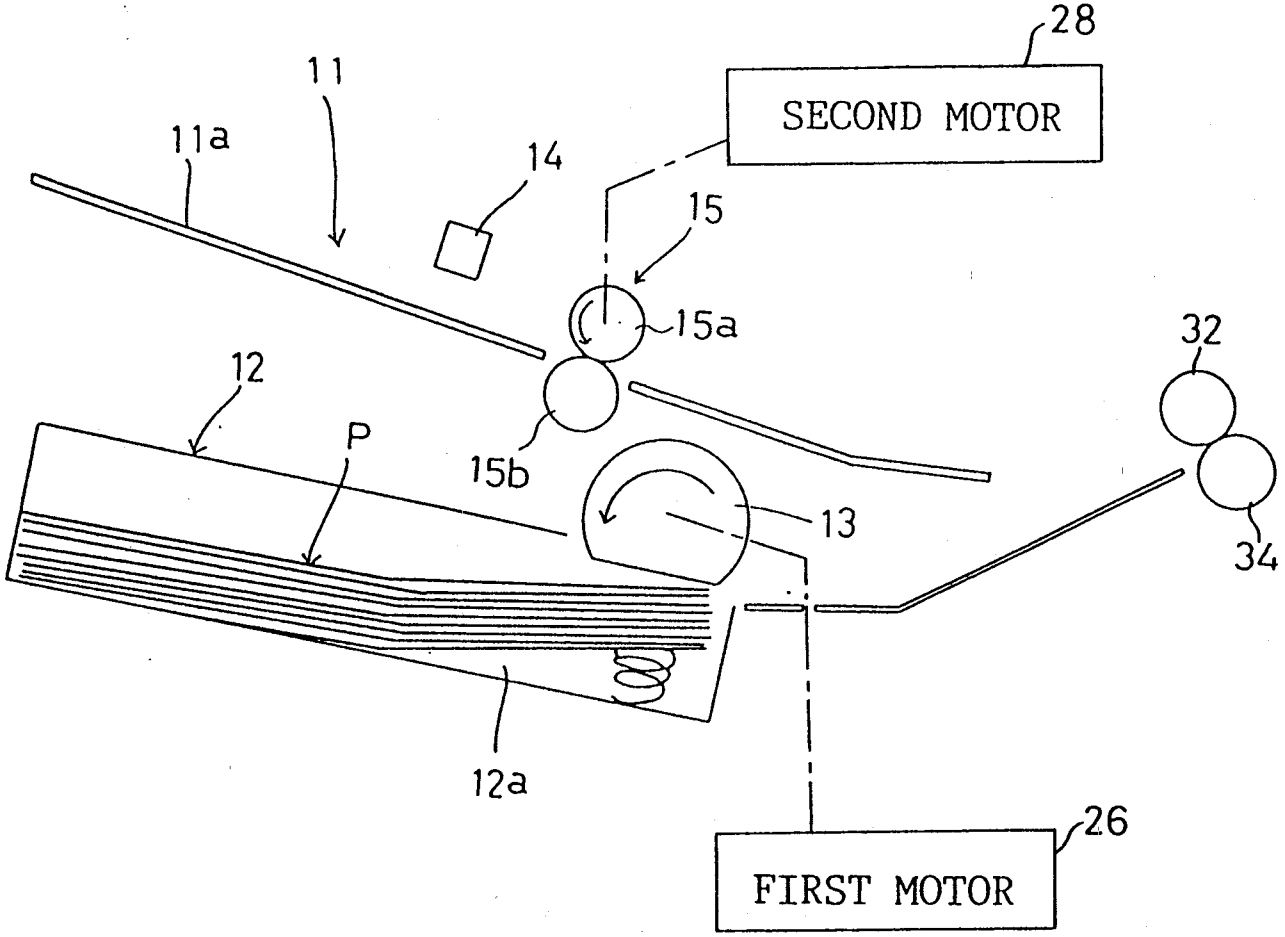
FIG. 2 illustrates the sheet feeder of a laser printer.

FIG. 2 shows the detailed structures of the manual sheet feeder 11 and the automatic sheet feeder 12 for feeding the print paper P.

The automatic sheet feeder 12 comprises a paper cassette 12*a* for containing therein a plurality of print paper sheets P in a stack, and a pick-up roller 13 in contact with the uppermost sheet of paper P in the paper cassette 12 for picking up one sheet after another sheet in sequence from the uppermost print paper P. The pick-up roller 13 is driven to be rotated by a first motor 26. In the automatic mode, the pick-up roller 13 rotates counter-clockwise in FIG. 2 and stops. Then the uppermost print paper P in the paper cassette 12*a* is fed upon one rotation of the pick-up roller 13 counterclockwise, and the leading edge of the print paper P reaches between a pair of transporting rollers 32 and 34, which are arranged in the upstream side of the transporting path of the print paper P. Then the print paper P is carried up toward the print unit 10 by the pair of transporting rollers 32 and 34.

The manual sheet feeder 11 comprises a manual insertion guide 11*a* and feed rollers 15 arranged at the front end of the manual insertion guide 11*a*. A sheet detector 14 is disposed above the manual insertion guide 11*a*. The feed rollers 15 include a drive roller 15*a* driven to be rotated by a second motor 28 and a driven roller 15*b* rotated by the drive roller 15*a*. Upon manual insertion of the print paper P between the drive roller 15*a* and the driven roller 15*b* along the manual insertion guide 11*a*, the sheet detector 14 detects the print paper P, and the drive roller 15*a* is rotated counterclockwise in the direction indicated by the arrow in FIG. 2, thereby carrying out the manual sheet feed. Since the pick-up roller 13 is not rotated in the manual mode, it is impossible that the print paper P is fed from both of the automatic sheet feeder 12 and the manual sheet feeder 11.

Figure 3:
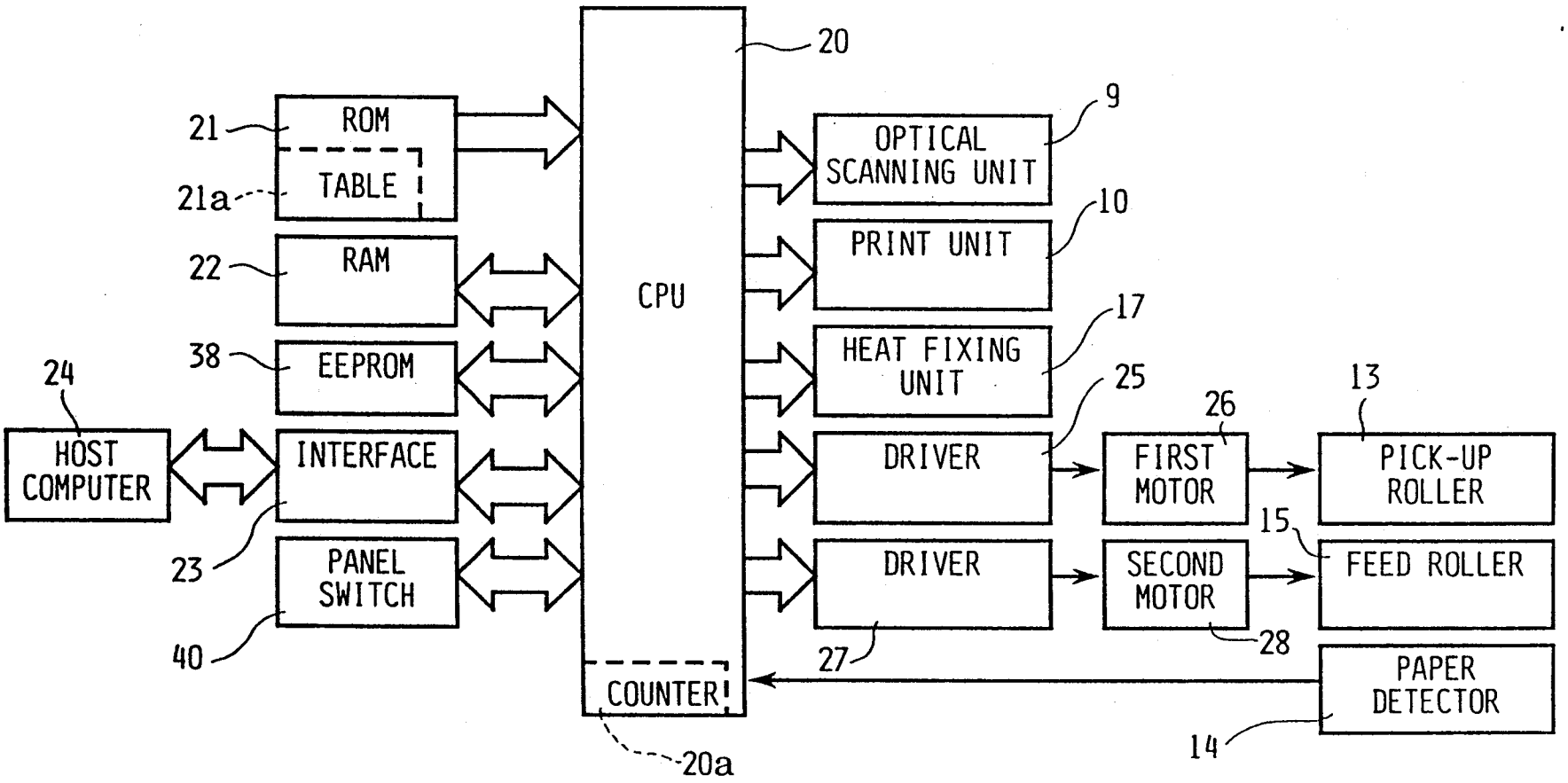
FIG. 3 is a block diagram showing the electrical system of the laser printer

Next, the electrical constitution of the laser printer will be explained referring to the block diagram of FIG. 3.

A CPU 20 for controlling the laser printer is connected to a ROM 21, a RAM 22, an EEPROM 38, an interface 23 and a panel switch 40.

The ROM 21 stores therein a program for controlling the entire laser printer, a sheet feed selection program, and the other necessary data. The ROM 21 also contains a table 21*a* in which a predetermined value of the time, taken from when the feed rollers 15 are first driven to when the next print paper P is fed, for a plurality of sizes of printing paper, is stored.

The RAM 22 temporarily stores therein print data, and data derived during the operation of the laser printer.

The interface 23 is connected to a host computer 24, which outputs print data such as characters and symbols, and control data to the CPU 20 via the interface 23. An external unit according to the present invention comprises the host computer 24.

An operator can arbitrarily set the predetermined value of paper size from the panel switch 40. This predetermined value is stored in the EEPROM 38 and is maintained therein after the power supply is terminated. The operator sets the size of the paper to be fed in the manual mode on the panel switch 40, for example, the operator selects and sets "A4 vertical" on the panel switch 40 when a print paper of A4 size is fed in the vertical direction in the manual mode.

The CPU 20 is connected to the optical scanning unit 9, the print unit 10, the heat fixing unit 17, and further, is connected to the first motor 26 for driving the pick-up roller 13 via a driver 25, and to the second motor 28 for driving the feed rollers 15 through a driver 27. The CPU 20 controls the optical scanning unit 9, the print unit 10, the heat fixing unit 17, the first motor 26 and the second motor 28. Moreover, the CPU 20 is connected to the sheet detector 14 for detecting the presence of the print paper on the manual insertion guide 11*a*. Furthermore, the CPU 20 contains therein a counter 20*a*, which counts the time.

FIG. 4 shows a table 21*a* where the predetermined value is stored, which corresponds to the time from when the paper supplying rollers 15 is first driven to the time when a following printing paper P is fed. The predetermined value which is stored in the table 21*a* corresponds to a paper length (length of printing paper P). The CPU 20 compares this predetermined value and the value counted by the counter 20*a*. For instance, if the operator selects "A4 vertical" on the panel switch 40 as the paper to be inserted in the manual mode, the CPU 20 compares the predetermined value 14.0 which corresponds to the above paper length and the value counted by the counter 20*a*, since the paper length is 305 millimeters. Additional tolerance time is added to the predetermined values corresponding to the time from when the feed rollers 15 start to drive to the time when the trailing end of the print paper P passes the discharge sensor 19 so that the predetermined time is greater than the normal time of travel of a sheet through the feed path. Furthermore, the predetermined value set by the above-mentioned panel switch 40 cannot be set as a value which is smaller than the minimum predetermined value 11.0. This prevents the following print paper P from being fed from the automatic sheet feeding means before the printing operation of the present print paper P ends, thereby preventing the print paper P from being fed in a superimposed state, which could result if the time between operation of the feed rollers 15 and feed roller 13 or between successive operations of the feed roller 13 is too short (i.e., the predetermined value is too small).

Figure 5:
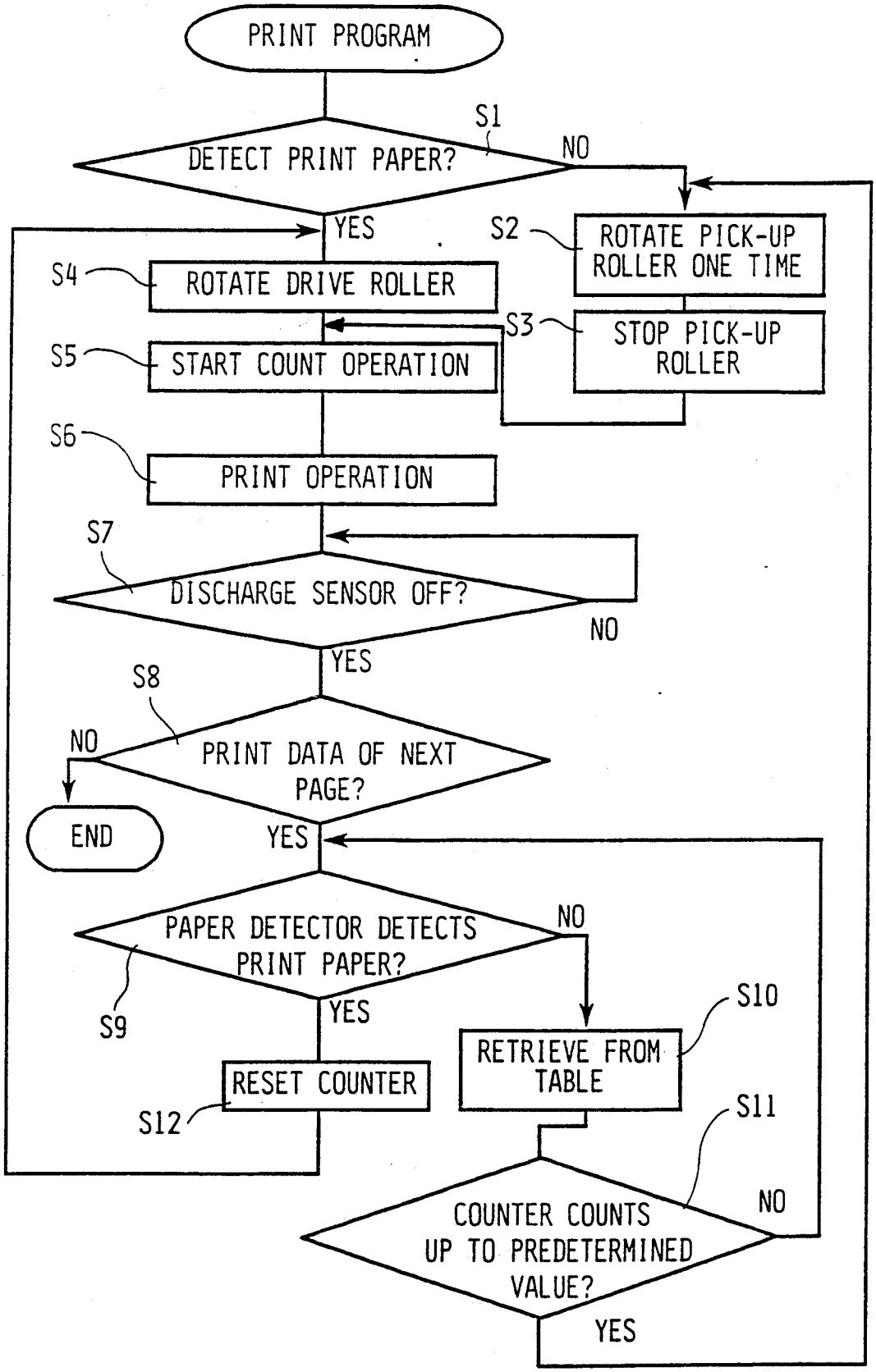
FIG. 5 is a flowchart illustrating a print program of the laser printer.

The sheet feed operation of the laser printer so constituted as described above will be explained with reference to FIG. 5, a flowchart showing the paper feed operation.

When the CPU 20 receives the print data including the control data from the host computer 24 via the interface 23, the CPU 20 stores the print data in sequence in the RAM 22. The CPU 20 executes a print program shown in FIG. 5 upon the receipt of a print command from the host computer 24.

In the print program, the CPU 20 determines in step 1 (hereinafter referred as to "S1", and S2, S3, et seq. in the same manner) whether or not the sheet detector 14 detects the print paper P in the manual sheet feeder 11. Since the sheet detector 14 does not detect the print paper P if there is no print paper P in the manual paper feeder 11, the CPU 20 determines NO in S1, and jumps to S2. The CPU 20 drives the first motor 26 via the driver 25 in S2, to rotate the pick-up roller 13 one time, thus automatically feeding the print paper P in the paper cassette 12*a* toward the print unit 10. After that, the CPU 20 stops the pick-up roller 13 in S3.

Meanwhile, when the operator inserts the print paper P in the manual insertion guide 11*a*, the CPU 20 receives a signal indicative of the detection of the print paper P by the sheet detector 14. At this time, the operator selects the print paper P to be fed in the manual mode on the panel switch 40, for example, "A4 vertical" is set in this embodiment.

The CPU 20 determines YES in S1 on the basis of the signal, and drives the second motor 28 via the driver 27 in S4, to rotate the drive roller 15*a* and the driven roller 15*b*, hence manually feeding the print paper P inserted in the manual sheet feeder 11 toward the print unit 10. Simultaneously, the CPU 20 starts a count operation of the counter 20*a* in S5, and proceeds to S6.

In S6, the print unit 10 performs the print operation on the print paper P. During the print operation, the CPU 20 first reads the print data in sequence from the RAM 22, and controls the optical scanning unit 9 and print unit 10, thus forming the visible image of characters on the photosensitive drum 2 on the basis of the print data. Subsequently, the CPU 20 transfers, by the transfer charger 5, the visible image formed on the photosensitive drum 2 onto the print paper P fed in S2 or S4. The print paper P with the image transferred thereon is separated from the surface of the photosensitive drum 2 by the separation discharging brush 6, to be transported to the heat fixing unit 17 so that the image is fixed by the heat roller 16*a*, and then, the print paper P is discharged to the paper discharge tray 18.

The CPU 20 determines in S7 whether or not the discharge sensor 19 has turned OFF, that is, whether or not the trailing end of the print paper P has passed under the discharge sensor 19. If the discharge sensor 19 is OFF, the CPU 20 determines YES and proceeds to S8 upon the completion of the print operation. If the CPU 20 determines NO, the CPU 20 waits for the completion of the print operation in S6.

The CPU 20 determines in S8 whether or not the RAM 22 stores therein the print data of the next page, and terminates the program in case of no print data.

If print data is stored, the CPU 20 determines YES and executes the program in S9 to determine whether or not the paper detector 14 detects the print paper P in manual paper feeder 11. If the print paper P is not detected, the CPU 20 determines NO and proceeds to S10. The CPU 20 retrieves the predetermined value corresponding to the paper length set from the switch panel 40 by the operator. In this embodiment, since "A4 vertical" is set by the operator, the predetermined value 14.0 corresponding thereto is retrieved from the table 21*a* of FIG. 4. Then the CPU 20 determines in S11 whether or not the counter 20*a* has counted up to the predetermined value 14.0. When the counter 20*a* has counted up to the predetermined value 14.0, the CPU 20 determines YES and executes the program in S2 to drive the first motor 26 and rotates the pick-up roller 13, thus performing the automatic paper feed. Meanwhile, if the counter 20*a* has not reached to the predetermined value, the CPU 20 determines NO and executes the program in S9 again, and determines whether or not the paper detector 14 detects the print paper P.

In S9, when the paper detector 14 detects the print paper P, namely, the operator has inserted a print paper P in the manual sheet feeder 11*a*, the CPU 20 receives a signal indicative of the detection from the sheet detector 14. Since the CPU 20 need not determine whether or not the counter 20*a* counts up the predetermined value, the CPU 20 determines YES in S9 on the basis of the signal and proceeds to S12. Thus, the operator can insert the next print paper P after the former print paper P is fed and the rotation of the fed rollers 15 is stopped.

The CPU 20 stops the count operation of the counter 20*a* in S12. The CPU 20 executes the program in S4 again, to rotate the feed rollers 15, thereby performing the manual sheet feed.

In the laser printer in the present embodiment as apparent from the above description, if the print paper P is inserted in the manual sheet feeder 11 within a predetermined time after the manual sheet feed is performed, the print data of the next page is printed on the print paper P fed in the manual mode. The feed is enabled when a discharge sensor senses, by the passage of a previous sheet, that the print operation is completed. Accordingly, a plurality of print papers P are not manually fed in a superimposed state. The automatic sheet feed means is not enabled until after the passage of a predetermined time, so that the manual paper feed can be continuously performed.

The present invention is not limited to the above mentioned embodiment, and can be practiced in various modifications. For example, although in the present embodiment the print of the next page is not started until the print paper is manually fed or automatically fed in the automatic mode after the elapse of a predetermined time once the manual sheet feed is performed, there may be provided a switch for releasing the manual sheet feed. When the switch is depressed, the pick-up roller is rotated to perform the automatic sheet feed, and the manual sheet feed is forcibly prohibited even within the predetermined time.

In addition, the feed rollers 15 of the manual sheet feeder 11 and the pick-up roller 13 of the automatic sheet feeder 12 are driven by the independent motors in the present embodiment. With disposition of only one motor and switch means for selectively transmitting the drive of the motor to the feed rollers 15 or the pick-up roller 13, the CPU 20 may control the switch means to change over the manual mode and the automatic mode.

Further, although in this embodiment the paper to be inserted by the manual mode is set by the switch panel 40, there may be provide guide member on the rear end of the manual insertion guide 11*a* to be moved along the paper length direction. In this case, the paper is automatically set merely by setting the paper on the manual insertion guide 11*a* and moving the guide member.

What is claimed is:

1. A printer having a manual sheet feed means and an automatic sheet feed means comprising:

print means for printing characters on the basis of print data output from an external unit on a sheet;

manual sheet feed means having a drive means for manually feeding sheets inserted by an operator to said print means;

sheet detector means for detecting if a sheet is inserted in said manual sheet feed means;

counter means for starting a count operation at the time when said manual sheet feed means is driven; and sheet feed control means for controlling said manual sheet feed means, said sheet feed control means including means to cause said manual sheet feed drive means to operate during a time when said sheet detector means detects the presence of the sheet until completion of the count operation of a predetermined value by said counter means.

2. The printer according to claim 1, wherein said manual sheet feed means has a manual sheet insert portion for inserting the sheet to be fed in a manual mode, and said sheet detector means detects if there is a sheet on the manual sheet insert portion.

3. The printer according to claim 1, further comprising means for setting a predetermined value which corresponds to the length of a sheet fed in the manual mode.

4. The printer according to claim 1, further comprising memory means in which the predetermined value is stored.

5. The printer, according to claim 1, further comprising a sheet cassette in which a plurality of sheets may be stacked, a drive member, automatic sheet feed means for automatically feeding sheets stacked in the paper cassette one after another to said print means.

6. The printer according to claim 5, further comprising means for setting the predetermined value to a time value necessary for said manual sheet drive means to be driven to complete feeding of a sheet fed by said manual sheet feed means, or a time value necessary to feed sheets stacked in the sheet cassette by said automatic paper feed means.

7. The printer according to claim 5, wherein said sheet feed control means includes means to prevent the drive of said automatic sheet feed means until said counter means reaches the predetermined value.

8. The printer according to claim 5, wherein said sheet feed control means includes means to enable operation of the drive member of said automatic sheet feed means when said counter means reaches the predetermined value before a sheet is detected by said sheet detector means.

9. The printer according to claim 5, wherein the drive means of said manual paper feed means and the drive member of said automatic paper feed means comprise rollers.

10. The printer according to claim 1, further comprising a discharge tray on which the printed sheets are discharged, and a discharge sensor for sensing when the leading end of a sheet passes and for sensing when the trailing end of a sheet passes, thereby detecting that the printed sheet is discharged.

11. The printer according to claim 10, further comprising means for determining the completion of a printing operation when the discharge sensor senses passage of the trailing end of a sheet fed by the manual sheet feed means.

12. The printer according to claim 11, wherein the predetermined value exceeds a time value representative of the time necessary for the printing operation to be completed.

13. The printer according to claim 1, further comprising:

automatic sheet feed means; and means for causing the automatic sheet feed to operate when the sheet detector detects the absence of a sheet in the manual insert portion and the counter has reached said predetermined value.

14. A printer comprising:

print means for printing on a sheet;

manual sheet feed means having a manual sheet insert portion for inserting sheets to be fed in a manual mode and a manual sheet feed roller for manually feeding sheets inserted from the manual sheet insert portion by an operator to said print means;

automatic sheet feed means having a cassette in which a plurality of sheets are stacked and an automatic sheet feed roller for automatically feeding sheets stacked in the cassette serially to said print means;

sheet detector means for detecting the presence of a sheet in the manual sheet insert portion;

counter means for starting a count operation at the time when the manual sheet feed roller is driven;

a discharge tray provided downstream of a sheet feed path, on which sheets printed by said print means are discharged;

a discharge sensor for sensing when the leading end of a printed sheet passes and when the trailing end of the printed sheet passes, thereby detecting that the printed sheet is discharged;

memory means for storing a predetermined value comprising the time when said manual paper feed roller is started until said discharge sensor detects that the sheet is discharged, plus a tolerance time; and sheet feed control means for starting the drive of said automatic sheet feed means when a sheet is not detected by said sheet detector means by the time that the value counted by said counter means becomes equal to the predetermined value stored in said memory means.

15. The printer according to claim 14, wherein said sheet feed control means starts the drive of said manual paper feed means when a sheet is detected by said sheet detector means before said counter means reaches the predetermined value.

16. The printer according to claim 15, further comprising a panel switch for disabling the manual sheet feeding means, whereby said sheet feed control means prohibits the drive of said manual sheet feed means when the panel switch is actuated even if a sheet is detected in the manual sheet insert portion by said sheet detector means.

17. The printer according to claim 15, further comprising feed rollers located downstream of the automatic sheet feed means in the sheet feeding path, and said sheet feed control means includes means to stop the drive of said automatic sheet feed means when a sheet reaches the feed rollers.

18. The printer according to claim 14, wherein the memory means includes means for storing a plurality of predetermined values corresponding to a plurality of sheet paper lengths to be fed by the manual sheet feed means.

19. The printer according to claim 18, further comprising a panel switch for setting said plurality of sheet lengths.

20. The printer according to claim 18, further comprising a panel switch for selectively setting one of the predetermined values, and said paper feed control means includes means for comparing the value counted by said counter means and the predetermined value stored in said memory means and set by the panel switch.

21. The printer according to claim 20, wherein a lowest predetermined value selectable by the panel switch is greater than the lowest predetermined value stored in the memory means.

22. The printer according to claim 20, wherein said memory means comprises a rewritable ROM.

23. The printer according to claim 14, wherein said sheet feed control means includes means to prevent the drive of said automatic sheet feed means until the value counted by the counter means equals the predetermined value.

24. A printer comprising:

a printer for printing on a sheet;

manual sheet feed means having a sheet insert portion for manually feeding sheets to the printer;

automatic sheet feed means for feeding sheets from a supply of a plurality of sheets to the printer;

sheet detector means for detecting the presence of sheets in the sheet insert portion of the manual sheet feeding means;

counter means for starting a counter operation when a sheet is fed from the manual insert portion of the manual sheet feed means;, a discharge sensor for sensing the discharge of a sheet from the printer; and sheet feed control means for controlling said manual sheet feed means in response to a signal from the discharge sensor and for controlling said automatic sheet feed means in response to the counter means reaching a predetermined count to prevent superimposed feeding of sheets.

25. The printer according to claim 24, further comprising:

means for setting a predetermined value which corresponds to the length of a sheet fed in the manual mode; and means for comparing the count of the counter means with said predetermined value.

26. The printer according to claim 24, further comprising memory means in which the predetermined value is stored.

27. The printer according to claim 26, wherein the memory means includes means for storing a plurality of predetermined values corresponding to a plurality of sheet paper lengths to be fed by the manual sheet feed means.

* * * * *